US008641015B2

(12) United States Patent
Omarsson et al.

(10) Patent No.: US 8,641,015 B2
(45) Date of Patent: Feb. 4, 2014

(54) CARBURETTORS

(76) Inventors: Kristjan Björn Omarsson, Rejkjavik (IS); Stephen Brian Glover, Comber (GB); David James Caley, City Beach (AU); Morten Kronstedt, Mindarie (AU)

( * ) Notice: Subject to any disclaimer, the term of this patent is extended or adjusted under 35 U.S.C. 154(b) by 0 days.

(21) Appl. No.: 13/531,790

(22) Filed: Jun. 25, 2012

(65) Prior Publication Data

US 2013/0161843 A1 Jun. 27, 2013

Related U.S. Application Data

(62) Division of application No. 12/601,824, filed as application No. PCT/GB2008/001766 on May 23, 2008.

(30) Foreign Application Priority Data

May 25, 2007 (GB) ..... 0710104.1
Oct. 29, 2007 (GB) ..... 0721049.5

(51) Int. Cl.
*F02M 7/14* (2006.01)

(52) U.S. Cl.
USPC ..... 261/57; 261/58

(58) Field of Classification Search
USPC ..... 261/41.5, 44.6–44.8, 54–58, 121.3, 261/DIG. 1, DIG. 74
See application file for complete search history.

(56) References Cited

U.S. PATENT DOCUMENTS

| | | | | |
|---|---|---|---|---|
| 3,661,367 | A | 5/1972 | Mennesson | 261/41.5 |
| 3,859,974 | A | 1/1975 | Ross | 123/179.18 |
| 4,229,384 | A | 10/1980 | Karino et al. | 261/39.5 |
| 4,308,837 | A | 1/1982 | Nohira et al. | 123/442 |
| 4,387,063 | A | 6/1983 | Pontoppidan | 261/41.5 |
| 4,484,557 | A | 11/1984 | Matsubara | 123/439 |
| 4,853,160 | A | 8/1989 | Wood | 261/41.5 |

(Continued)

FOREIGN PATENT DOCUMENTS

| | | |
|---|---|---|
| DE | 464031 | 8/1928 |
| DE | 1281744 | 10/1968 |

(Continued)

OTHER PUBLICATIONS

International Search Report in PCT/GB2008/001766 dated Oct. 1, 2008.

*Primary Examiner* — Richard L Chiesa
(74) *Attorney, Agent, or Firm* — Donn K. Harms

(57) ABSTRACT

A carburettor including a primary air passage, an adjustable throttle valve situated within the primary air passage, a fuel supply nozzle communicating with the primary air passage and connected to a fuel metering valve for varying the amount of fuel discharged through the nozzle and a rotary input shaft adapted to be connected to an engine speed control member and which is connected to the throttle valve to move the throttle valve between open and closed positions. The rotary input shaft is also connected to a carriage to move the carriage, the carriage carrying at least one elongate inclined ramp which extends in the direction of movement of the carriage and which is engaged by a follower connected to the valve member. Rotation of the input shaft results in movement of the throttle valve and in movement of the carriage and thus of the elongate ramp, wherein the follower is moved transverse to the length of the ramp and the valve member of the fuel metering valve is thus also moved.

6 Claims, 12 Drawing Sheets

(56) References Cited

U.S. PATENT DOCUMENTS

| | | | | |
|---|---|---|---|---|
| 4,931,226 | A | 6/1990 | Ishii | 261/41.5 |
| 6,827,338 | B2 * | 12/2004 | Nonaka | 261/44.3 |
| 6,845,972 | B2 | 1/2005 | Nonaka | 261/50.2 |
| 7,722,015 | B2 * | 5/2010 | Koizumi | 261/23.3 |
| 2004/0130040 | A1 * | 7/2004 | Araki | 261/34.2 |
| 2005/0104235 | A1 * | 5/2005 | Sasaki et al. | 261/44.6 |
| 2008/0001315 | A1 | 1/2008 | Shedd et al. | 261/121.3 |
| 2010/0176519 | A1 * | 7/2010 | Omarsson et al. | 261/44.2 |

FOREIGN PATENT DOCUMENTS

| | | | | |
|---|---|---|---|---|
| FR | 623232 | | 6/1927 | |
| GB | 2068055 | | 8/1981 | |
| JP | 63-88257 | A * | 4/1988 | 261/44.6 |
| WO | WO 97/48897 | | 12/1997 | |

* cited by examiner

CARBURETTORS

CROSS-REFERENCES TO RELATED APPLICATIONS

This application is a divisional of U.S. application Ser. No. 12/601,824, filed Nov. 25, 2009 and also titled "Carburettors" which is a national stage application of International Application No. PCT/GB2008/001766 filed on May 23, 2008. This application claims priority to and the benefit of said parent application, and parent application is incorporated by reference as if set forth fully herein.

The present invention relates to carburettors for two-stroke and, more particularly, four-stroke internal combustion engines and is concerned with that type of carburettor which includes a primary air passage, an adjustable throttle valve situated within the primary air passage and a fuel supply nozzle communicating with the primary air passage and connected to a fuel metering valve for varying the amount of fuel discharged through the nozzle.

Such carburettors are well known. Different types of metering valve are known but the most commonly used type of valve is a needle valve. Such valves include an elongate valve needle cooperating with an orifice which constitutes the fuel supply nozzle. The valve needle of a needle valve is inherently a relatively long, slender component, which is supported only at one end and it is the other unsupported end which cooperates with the orifice and controls the flow rate of the fuel. It is a requirement of carburettors that they provide a reliable, accurate and repeatable control of the fuel/air mixture at idle speed, full speed and intermediate speed settings of the engine and it is found that a needle valve is inherently incapable of this because even very small lateral movements in the unsupported end of the valve need can lead to quite large variations in the pattern and volume of the fuel flow, particularly at low engine speeds. This can result in variations in the air/fuel ratio and thus in an increase in fuel consumption and in pollutant emissions and in instability of engine operation, particularly when idling. It is also desirable in mass produced carburettors that the performance and characteristics of all of them is identical and it is found that this is in practice not the case, largely due to the difficulty in making the size and position of the valve needles precisely identical. Furthermore, in order to ensure that the supply of air and fuel are appropriately matched in the known carburettors, the throttle valve and needle valve are linked to move together by a complex mechanical linkage. This linkage is prone to variations in manufacturing tolerances and requires complex and expensive machining and assembly.

It is therefore an object of the present invention to provide a carburettor which enables the fuel supply to be controlled in a more accurate, reliable, reproducible and compact manner. It is a further object of the invention to provide a carburettor which will result in stable, economical and reproducible operation, particularly at low and idling speeds of the engine. It is a still further object of the invention to provide a carburettor in which the fuel supply is adjustable in a manner which is directly related to the speed and/or load of the engine in a manner which is robust, reliable and compact and in which the adjustment mechanism is contained within the body of the carburettor.

In accordance with this invention there is provided a carburettor further including a primary air passage, an adjustable throttle valve situated within the primary air passage, a fuel supply nozzle communicating with the primary air passage and connected to a fuel metering valve for varying the amount of fuel discharged through the nozzle, and a rotary input shaft adapted to be connected to an engine speed control member and which is connected to the throttle valve to move the throttle valve between open and closed positions, the rotary input shaft being also connected to a carriage to move said carriage, the carriage carrying at least one inclined ramp surface means which extends in the direction of movement of the carriage and which is engaged by a follower connected to the valve member, wherein rotation of the input shaft results in movement of the throttle valve and in movement of the carriage and thus of the ramp surface means, so that the follower is movable transverse to the length of the ramp surface means and the valve member of the fuel metering valve is thus also moved.

It is preferred that the carriage carries one or more parallel tracks, the carriage being connected to one or more support members which bear against respective tracks, whereby the carriage is guided to move linearly. It is therefore necessary that the input shaft is connected to the carriage by a linkage which will convert rotary motion of the shaft into linear motion of the carriage and it is preferred that this linkage is of lost motion type. Conveniently, the shaft carries a lever bearing a projection, which is received in an elongate slot in the carriage.

The input shaft must also be coupled to the throttle valve to move it in synchronism with the valve member of the fuel metering valve and it is preferred that this connection is via the carriage and that the throttle valve is connected to the carriage by a further lost motion linkage, which converts the linear motion of the carriage into rotational motion of the throttling valve.

In one embodiment, the carriage includes one or more parallel inclined ramp surfaces and a valve carrier which is connected to the valve member and carries one or more rollers which are supported on respective ramp surfaces.

In an alternative embodiment, the carriage is connected to the rotary input shaft to rotate with it and the ramp surface is of part-circular shape. This embodiment has the advantage of simplicity in that the lost motion linkages are no longer necessary. As the carriage moves in rotation in synchronism with the rotary input shaft, the part-circular ramp surface will move also and the follower connected to the valve member will be caused to move in the direction of the length of the valve member, thereby moving the valve member axially.

As described above, the invention relates to many different types of carburettor including those with only a single air passage. It is, however, particularly applicable to carburettors of the type including a secondary air passage with an inlet and with an outlet to the primary air passage between the throttling valve and its outlet, the arrangement being such that, in use, the fuel mixes with the air flowing through the secondary air passage before mixing with the air flowing in the primary air passage. In practice this means that the outlet from the fuel metering valve is into the secondary air passage. Carburettors of this type are disclosed in WO 97/48897. The fact that the fuel supply nozzle communicates with the primary air passage downstream of the throttle valve rather than upstream of it, as is conventional, means that the fuel is forcibly pulled out from the fuel nozzle by the strongly sub-atmospheric pressure that prevails downstream of the throttle valve, particularly at small throttle openings, i.e. when the engine is running at low speed or idling. This is in distinction to the pressure which prevails upstream of the throttle valve, which is very much closer to atmospheric. This substantial pressure differential results in very much more efficient vaporisation of the fuel, particularly at low engine speed. This improved vaporisation is further promoted by the flow of air through the secondary air passage which mixes with the fuel before it enters the primary air passage, thereby beginning the vaporisation process earlier than normal. The result of the more rapid and efficient vaporisation of the fuel is more efficient combustion and thus reduced fuel consumption and also reduced emissions of pollutants.

In the preferred embodiment, the fuel supply nozzle includes a fuel inlet passage communicating with the outlet of the fuel metering valve, a mixture outlet passage communicating with the primary air passage and at least one air inlet passage which communicates with the secondary air passage and the mixture outlet passage.

The fuel supply nozzle preferably includes a bore of constant cross-sectional area whose upstream end communicates with the fuel outlet and whose downstream end is divergent and communicates with the primary air passage. The provision of the bore of constant cross-sectional area means that minor variations in the depth to which the divergent bore is formed will have no effect on the cross-sectional area of the communication between the secondary air passage and the primary air passage.

In an alternative embodiment, a nozzle unit defining a jet or nozzle orifice is secured within the mixture outlet passage. In practice, this will necessitate the mixture outlet passage being larger than in the previous embodiment and once this passage has been formed a nozzle unit or block defining an orifice is inserted into it and retained in position. This will again result in the cross-sectional area of the communication between the secondary air passage and the primary air passage being precisely predetermined and thus not subject to tolerances or minor variations in the manufacturing procedure.

In order to prevent an excessively low sub-atmospheric pressure being formed in the secondary air passage when the engine is idling, it is preferred that the minimum cross-sectional area of the secondary air passage over its entire length is greater than the cross-sectional area of the bore of constant cross-sectional area. This will result in a substantial proportion of the pressure gradient between the fuel outlet of the fuel metering valve and the primary air passage occurring between the secondary and primary air passages, whereby excessive amounts of fuel are not drawn into the secondary air passage from the fuel outlet when the engine is idling.

The benefits of the secondary air passage are particularly pronounced at low and mid speed of the engine because of the substantially improved vaporisation of the fuel. However, at high engine speeds, there is a substantial air flow through the primary air passage and a not insignificant air flow through the secondary air passage also. This may result in the air/fuel ratio falling to an undesirably low level under high engine loads. This potential problem may be eliminated if the secondary air passage includes a controllable valve, which may be operated by a separate actuator. This will enable the flow of air through the secondary air passage to be controlled independently of the air flow through the primary air passage. In one embodiment, the controllable valve is connected to the throttle valve and arranged to close progressively as the throttle valve opens. This means that as the engine load increases the air flow rate through the secondary air passage will not increase at the same rate and may indeed even decrease or go to zero when the throttle valve is fully open.

This feature is believed to be applicable to carburettors which do not include a fuel metering valve of the specific type referred to above and thus in a further aspect, a carburettor includes a primary air passage, an adjustable throttle valve situated within the primary air passage, a secondary air passage with an inlet and with an outlet to the primary air passage between the throttle valve and its outlet, the arrangement being such that, in use, the fuel mixes with the air flowing through the secondary air passage before mixing with the air flowing in the primary air passage is characterised in that the secondary air passage includes a controllable valve. This valve may be connected to the throttle valve and arranged to close progressively as the throttle valve opens.

In a preferred embodiment, the throttle valve is mounted on a rotary shaft through which a radial passage passes, the radial passage constituting a contiguous part of the secondary air passage, when the throttle valve is substantially closed, whereby as the throttle valve is opened the radial passage becomes progressively misaligned with the adjacent portions of the secondary air passage and thus progressively throttles the air flow through the second air passage. This arrangement is particularly simple and space-saving because it uses the shaft of the throttle valve itself to act as a throttle valve for the secondary air passage.

Further features and details of the invention will be apparent from the following description of certain specific embodiments, which is given by way of example only with reference to the accompanying drawings, in which.

In the Figures like reference numerals denote like parts.

Figure 1:
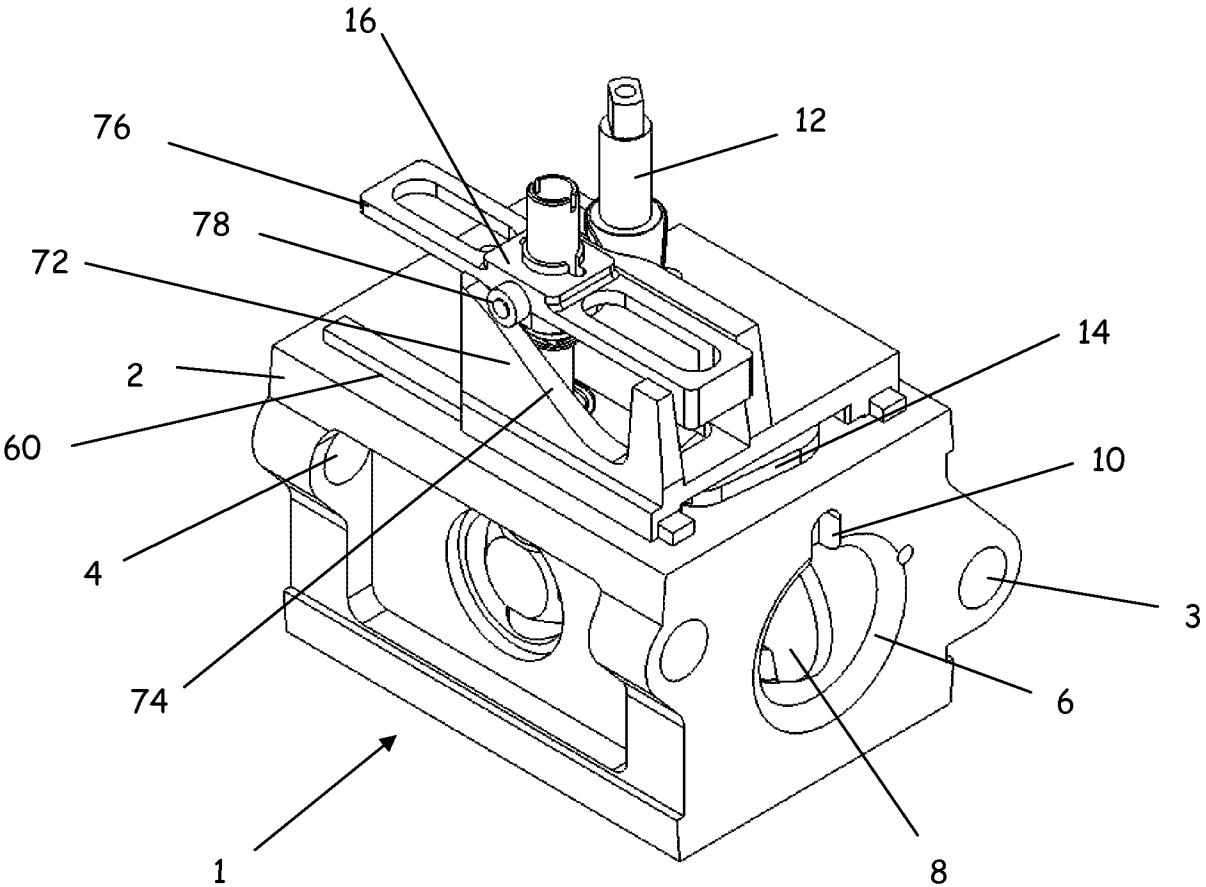
FIG. 1 is a front perspective view of a carburettor in accordance with the invention.

Referring firstly to FIGS. 1 to 3A, a carburettor 1 includes a body 2 defining a primary air passage 19 with an inlet 6 and a downstream air outlet 11. The body 2 is adapted to be connected to an air cleaner housing (not shown) via a flange 3 and to an engine inlet manifold (again not shown) via a flange 4. A throttle valve 8 of butterfly type is arranged in the primary air passage 19. The body 2 also defines a secondary air passage 13, which communicates with a secondary inlet 10 and whose downstream end, outlet 24, communicateds with a chamber 22. The chamber 22 accommodates a fuel metering valve 23, which will be described in detail below, and communicates via two passages 25, fed by the secondary air passage 13, with the inlet of a fuel supply nozzle 28, the outlet of which is directed into the primary air passage 19 downstream of the throttle valve 8.

Figure 4B:
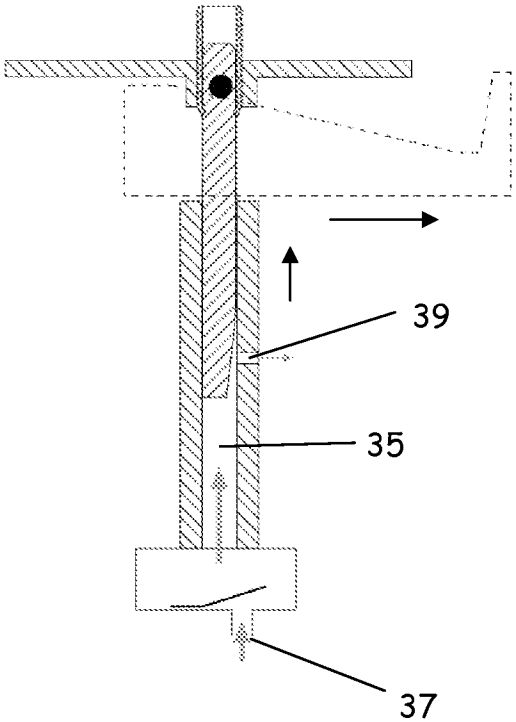
FIGS. 4A and 4B are sectional views of the fuel metering valve in the closed and partially open positions, respectively.
Figure 4A:
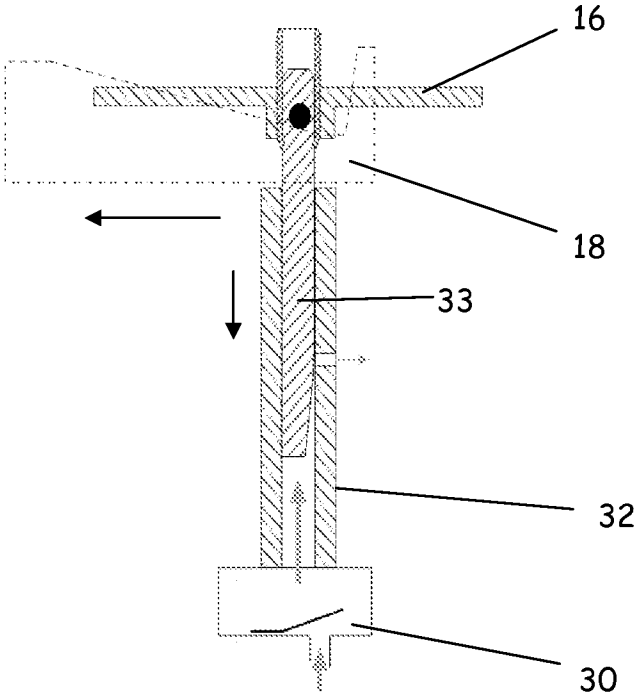

As shown in FIGS. 4A and 4B, the fuel metering valve 23 preferably consists of an outer elongate sleeve or tube 32, longitudinally slidably accommodated within which is a valve member 33, which is arranged to be moved in a vertical direction by a plate 16, as will be described below. The sleeve 32 defines a fuel inlet space 35 at its lower end which communicates with a fuel inlet 37 at its lower end via a non-return valve 30. This valve will prevent any backflow of fuel and will thus reduce the transient pressure changes and backflow of fuel that can occur and impairs the operation and efficiency of the engine. Provided in the side wall of the sleeve 32 is an outlet 39. The valve member 33 is of circular cross-section over the upper portion of its length and is in sliding and substantially sealed contact with the internal surface of the sleeve. However, at the lower end of the valve member its surface directed towards the outlet 39 is relieved or cut away progressively in the downwardly direction. Accordingly, when the valve member is in the position shown in FIGS. 4A, the outlet 39 is completely obscured by the surface of the valve member and there is no communication between the fuel space and the outlet. No fuel may therefore flow through the valve. However, as the valve member is progressively raised, the progressively decreasing cross-sectional area of the valve member will mean that the fuel space will communicate with the outlet 39 via a space of progressively increasing area and the rate of fuel flow through the outlet 39 towards the fuel nozzle 28 will progressively increase. The detailed shape of the cut-away portion of the valve member may be contoured to achieve any desired relationship between the position of the valve member and the instantaneous fuel flow rate.

In the preferred embodiment, the valve member 33 moves linearly within the sleeve 32, though it will be appreciated that it could also move in rotation or both linearly and in rotation. The valve member 33 is also of circular section in this preferred embodiment and this opens up the possibility, at least theoretically, of the valve member rotating within the sleeve and the cut-away portion becoming angularly misaligned with the outlet 39. This risk is eliminated in the modified embodiment shown in FIG. 5A in which the valve member is provided with an elongate groove 44 in its surface opposite to the outlet 39. A projection 46 integral with a plug 48 passing through the wall of the sleeve 32 extends into the groove 44 and engages its two side walls. Rotation of the valve member relative to the sleeve is therefore prevented by the guide 46, 48.

Figure 5B:
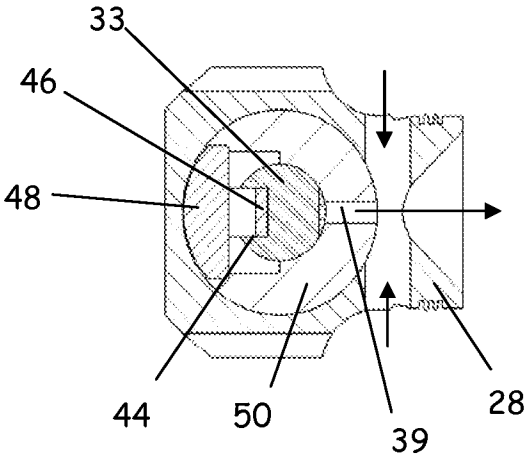
FIGS. 5A and 5B are longitudinal and transverse sectional views respectively of a modified fuel metering valve.

In the embodiment of FIG. 4, the upper portion of the internal surface of the sleeve 32 is in sliding sealed contact with the opposed surface of the valve member around its entire periphery so as to prevent leakage of fuel in the upward direction. It is, however, not necessary that the valve member be sealed around its entire periphery but merely that it be sealed around the outlet 39. In the modified embodiment of FIG. 5B, the valve sleeve 32 accommodates a sealing member 50 affording the outlet 39 and a semi-cylindrical recess in which the valve member 33 is received. The valve member 33 again has an elongate recess 44 formed in its side surface remote from the outlet 39 and this recess receives a projection 46 connected to a block 48. The projection 46 has a width equal to that of the recess 44 and is made of resilient material and thus urges the valve member to the right, as seen in FIG. 5. The valve member 33 is thus not only restrained from rotating but is urged into sealing contact with the seal 50 by the resilient projection 46.

Figure 5C:
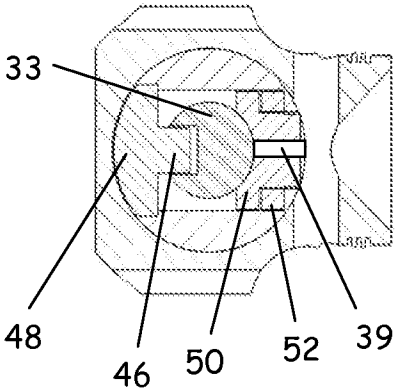
FIG. 5C is a view similar to FIG. 5B of yet a further modified fuel metering valve.
Figure 5A:
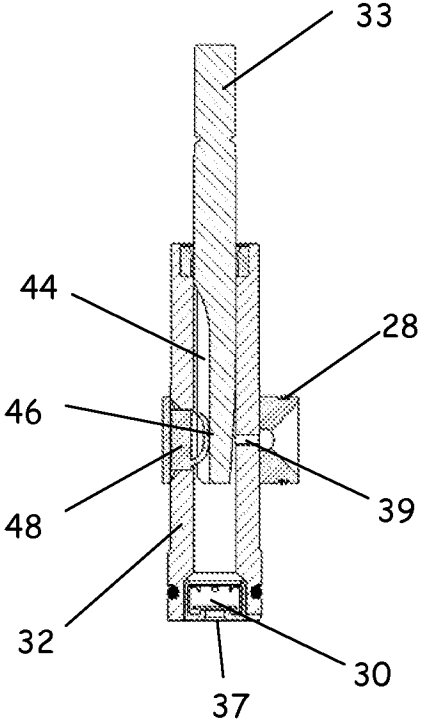

In the further modified embodiment of FIG. 5C, the valve member 33 is again provided with a guide 48, 46 extending into a longitudinal groove formed in it and is in sliding engagement with a seal 50 in which the outlet 39 is formed. The seal 50 is made of a hard polymeric material such as that sold by Victrex under the trade Mark PEEK. Situated behind the seal 50 is one or more magnets 52 which are attracted to the valve member 33, which, in this embodiment, is ferromagnetic, and thus urge the seal 50 into contact with the valve member 33, thereby enhancing the integrity of the seal. Alternatively, the material of the seal 50 may contain magnetised particles which draw the seal into contact with the valve member.

Figure 3B:
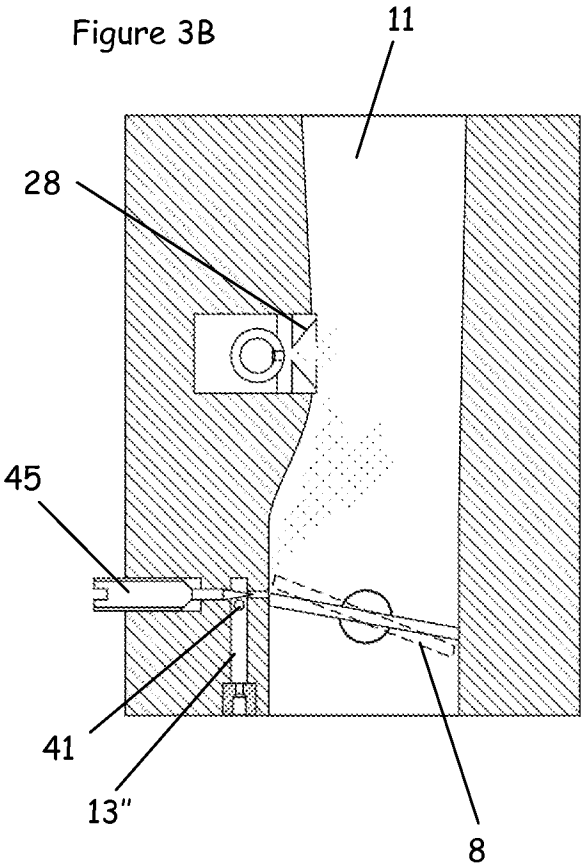
FIG. 3B is a view similar to FIG. 3A showing an optional feature.
Figure 3A:
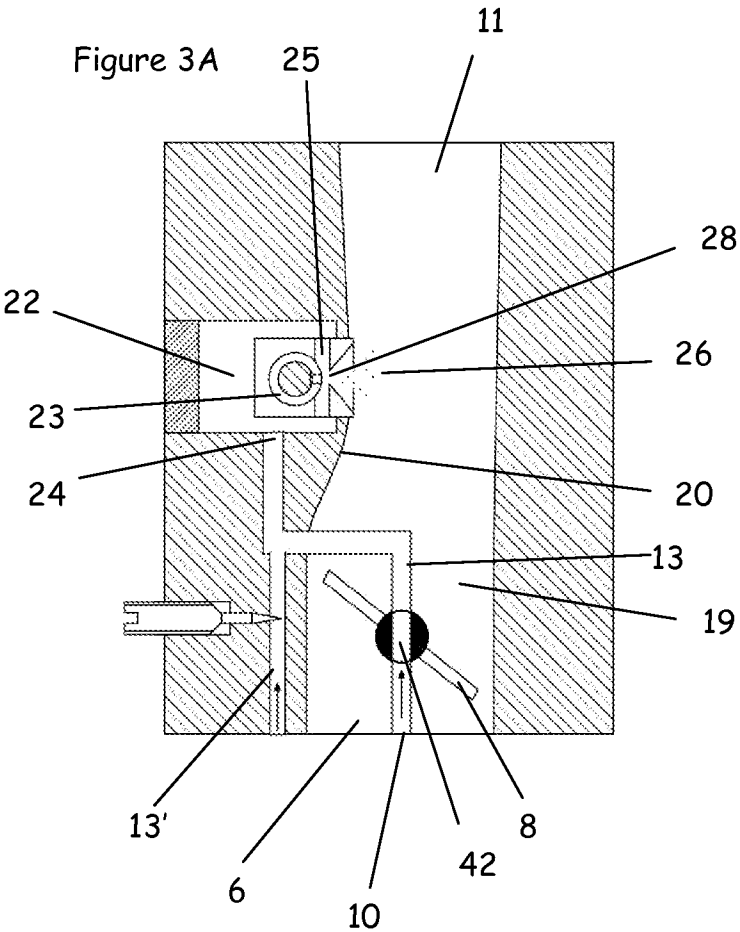
FIG. 3A is a scrap diagrammatic cross-sectional view of the carburettor of FIGS. 1 and 2.

FIG. 3A shows that the secondary air passage 13 includes a valve arranged to close progressively as the throttle valve 8 opens. In this case, the throttle valve includes a central rotary shaft 40, through which a radial air passage 42 passes. When the valve 8 is close to the closed position, the passage 42 constitutes part of the secondary air passage. However, as the valve 8 opens, the passage 42 becomes increasingly misaligned with the adjacent portions of the passage 13 and thus progressively throttles the flow of secondary air through the passage 13. When the valve 8 is in or near to the fully open position, the passage 13 will be closed and no secondary air will flow through the passage 13 to the nozzle 28. This will result in an increase in the richness of the fuel/air mixture at high engine loads but will not impair the efficiency of fuel injection and vaporisation because at high load the air flow through the primary air passage 19 is sufficiently rapid to ensure rapid entrainment and vaporisation of the fuel discharged through the nozzle 28.

However, it is desirable for there to be a small flow of secondary air even under high load conditions and this is achieved in the construction of FIG. 3A by the provision of a further secondary air passage 13' in parallel with an upstream portion of the secondary passage 13 and bypassing the valve constituted by the shaft 40 of the throttle valve 8.

As referred to above, the fuel flow rate may be varied between desired maximum and minimum rates. The maximum rate will correspond to maximum load of the engine. The minimum rate may be a very low rate corresponding to idling speed of the engine. However, it is as a practical matter difficult to reliably and precisely control a low rate of fuel flow through a valve which is adapted also to permit flow rates suitable for high speed engine operation. It is therefore preferred that the carburettor includes a further fuel metering valve, an idling metering valve, which also communicates with the primary air passage and is adapted to supply the small amount of fuel that is required for idling operation. Such a construction is shown in FIG. 3B, from which the secondary air passage has been omitted for the sake of clarity. As may be seen, an idling air passage 13" communicates with the air outlet 11 at a position which is downstream of the adjacent edge of the throttle valve 8, when it is substantially closed but is upstream of the throttle valve when it is open to an appreciable extent. The idling air passage communicates with a fuel supply orifice 41. The idling air passage 13" is controllable by means of a needle, controllable valve 45. The main fuel metering valve 23 is arranged to be substantially closed when the engine is idling. At this time the throttle valve 8 will be in the position shown in solid lines in FIG. 3B and the downstream end of the idling air passage 13" will be subjected to a substantial sub-atmospheric pressure. Air and fuel are thus drawn into the air passage in an amount sufficient for idling operation of the engine. The precise amount of fuel that is admitted may be controlled very precisely by adjusting the needle, controllable valve 45, which is only required to permit a relatively small range of flow rates. When the throttle is opened, the main fuel metering valve 23 will again begin to permit the flow of fuel. As the adjacent edge of the throttle 8 moves downstream of the downstream end of the idling air passage 13", the reduced pressure applied to the downstream end of the passage 13" decreases and the flow of fuel and air through the passage 13" drops to a very low value which is insignificant compared to the flow through the nozzle 28.

Figure 7C:
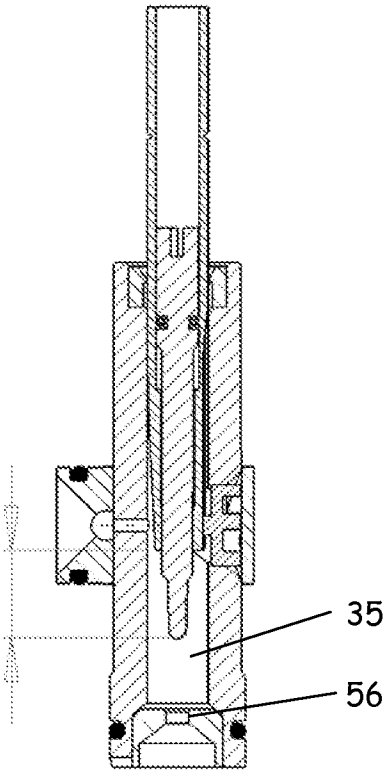
FIGS. 7A, 7B and 7C are axial sectional views of yet a further modified fuel metering valve.
Figure 7B:
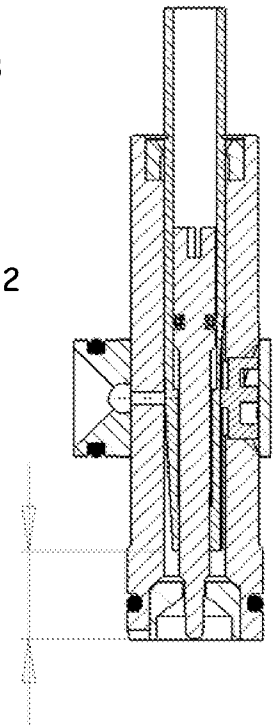
Figure 7A:
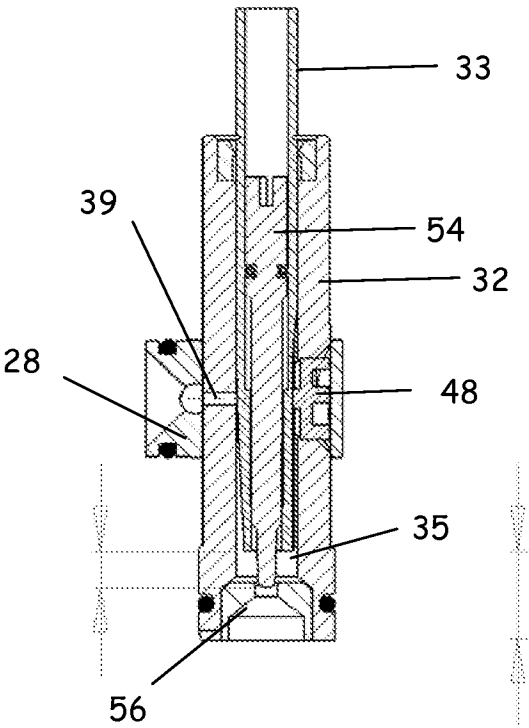

In the modified embodiment shown in FIG. 7A-C, the idling metering valve is incorporated in the valve member of the main fuel metering valve. In this case, the valve member 33 is hollow and accommodates within it a valve needle 54, a portion of whose external surface carries a screw thread in engagement with a corresponding screw thread on the interior of the valve member so that the relative axial positions of the valve member 33 and valve needle 54 are readily adjustable. The inlet to the fuel inlet space 35 constitutes a valve seat 56 with which the valve needle 54 cooperates. The valve member 33 is again profiled on its external surface directed towards the outlet 39 so as to produce the desired varying fuel flow rate as the valve member 33 is moved axially within the sleeve 32 and it is again restrained from rotation by engagement of a guide 48 in a longitudinal groove formed in the opposite surface. When the engine is operating at full speed, the valve member 33 will be in the position shown in FIG. 7C in which a significant volume of fuel is permitted to flow through the outlet 39 and the valve needle 54 is spaced well away from the valve seat 56. When the engine is not operating, the valve member 33 will be in the position shown in FIG. 7B in which the outlet 39 is closed by the valve member 33, though this is not necessarily so, and the valve seat 56 is completely blocked by the valve needle 54. However, when the engine is idling, as shown in FIG. 7A, the flow rate of the fuel is controlled not by the valve member 33 but by the valve needle 54. Thus the profiled portion of the exterior of the valve member 33 is so shaped that as the valve member 33 moves downwardly, the area of communication between the space 35 and the outlet 39 progressively decreases and whilst this occurs the valve needle 54 initially has no influence on the fuel flow rate. However, as the idling speed range is approached, the shape of the relevant portion of the surface of the valve member is such that the area of communication between the space 35 and the outlet 39 stays substantially constant and does not decrease yet further. However, as this point is reached, the valve needle 54 begins to influence the flow rate through the valve seat 56. Further movement in the downward direction of the valve member 33, and thus also the valve needle 54, will result in a reduction in the fuel flow rate but this reduction is all caused by the valve needle 54. The rate of fuel flow whilst idling may be adjusted very precisely by adjusting the position of the valve needle 54 within the valve member 33.

Figure 9B:
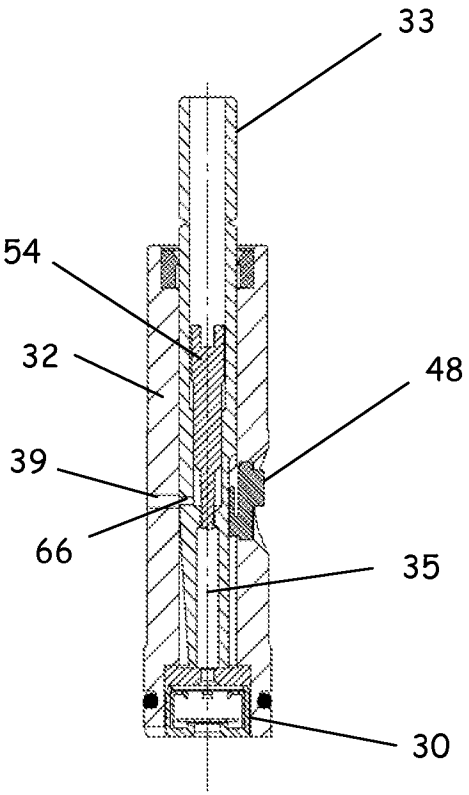
FIGS. 9A and 9B are axial sectional views of a still further modified fuel metering valve.
Figure 9A:
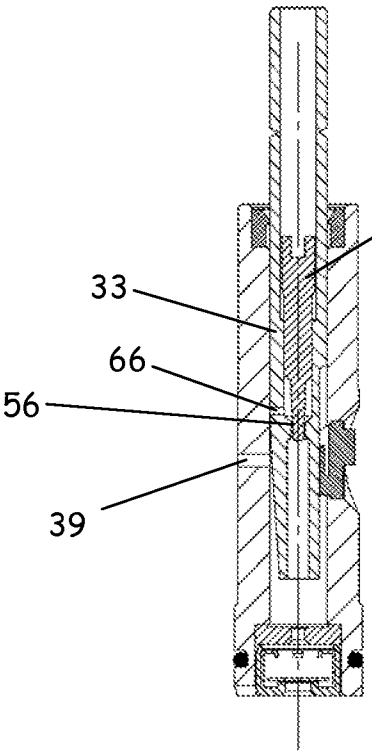

A further modified embodiment in which the idling metering valve is incorporated in the valve member of the main fuel metering valve is shown in FIGS. 9A and 9B. The valve member 33 is again hollow and again accommodates within it a valve member or needle 54 and the position of this valve needle within the valve member 33 is again adjustable by means of cooperating screw threads. In this case, however, the valve seat 56 with which the idling valve member 54 cooperates is defined within the valve member 33. Situated above the valve seat 56 within the valve member 33 is a liquid space communicating with an outlet 66 in the side wall of the valve member 33. In normal operation of the engine, as shown in FIG. 9A, the outlet 66 is closed by the opposed internal side wall of the sleeve 32 and no fuel can therefore flow through the valve constituted by the seat 56 and valve member 54. However, when the valve member 33 moves downwardly into the idling position, as shown in FIG. 9B, the outlet 66 comes into registry with the outlet 39 in the sleeve. Fuel can then flow through the idling metering valve 54, 56 and thence through the outlets 66 and 39. The two metering valves are effectively in parallel in this embodiment and the main fuel metering valve is therefore arranged to be fully closed during idling operation which means that all the fuel required for idling operation passes through the idling fuel metering valve. Since both the valve member 54 and the valve seat 56 move with the valve member 33, movement of the valve member 33 does not result in relative movement of the valve member 54 and valve seat 56 and this means that the flow rate through the idling metering valve is constant, though it may of course be adjusted to a desired value by adjusting the longitudinal position of the valve member 54 within the valve member 33 by rotating it.

The mechanism by which the fuel metering valve is actuated and controlled will now be described with reference to FIGS. 1, 2, 6 and 8. The upper surface of the carburettor carries two parallel elongate slide rails 60, slidably supported on which is a slide carriage 18. In use, the rails and carriage are within a removable cover, but this has been omitted from the drawings for the sake of clarity. Rotatably carried by the cover is a mechanical input shaft 12. Rigidly connected to the shaft 12 is a lever arm 61, depending from the free end of which is a peg 62, which is received in a slot 64 in the carriage 18. It will be appreciated that the peg 62 and slot 64 act as a lost motion linkage and that rotation of the shaft 12 will result in linear sliding motion of the carriage 18 along the rails 60. The rotary shaft 40 of the throttle valve 8 extends through the upper wall of the carburettor and is non-rotatably connected to one end of a lever 14. Formed in the upper surface of the lever 14 is a longitudinal slot 66 in which an elongate slider 68 is slidably received. The end of the slider 68 remote from the throttle shaft 40 is pivotally connected to the carriage 18 by means of a pivot pin 70. The slot 67 and slider 68 constitute a further lost motion linkage such that linear movement of the carriage 18 along the rails 60 will result in rotation of the shaft 40 and thus in opening or closing movement of the throttle valve 8.

Upstanding from the carriage 18 are two spaced parallel webs 72, the upper surface 74 of one of which is profiled and has a somewhat curved inclined ramp shape. Situated above the profiled ramp 74 is an elongate valve holder 76, projecting from one side of which is a roller 78 resting on the profiled ramp 74. At the centre of the valve holder 76 is a support plate 16, through which the valve member 33 of the fuel metering valve extends. The valve member 33 and support plate 16 are connected together such that relative vertical movement is prevented. The side of the valve holder 76 is a planar surface in sliding engagement with the opposed parallel surface of the other web 72. This flat engagement prevents tilting or skewing of the valve holder as it moves along the webs.

Figure 2:
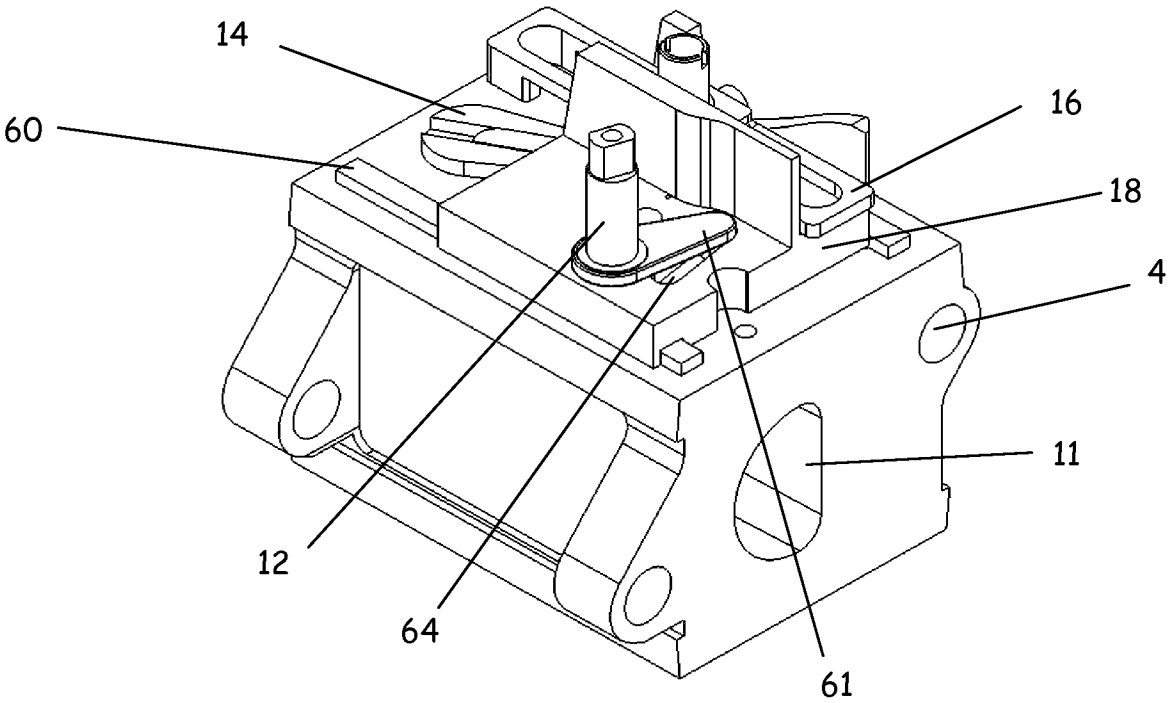
FIG. 2 is a rear perspective view of the carburettor of FIG. 1.
Figure 6C:
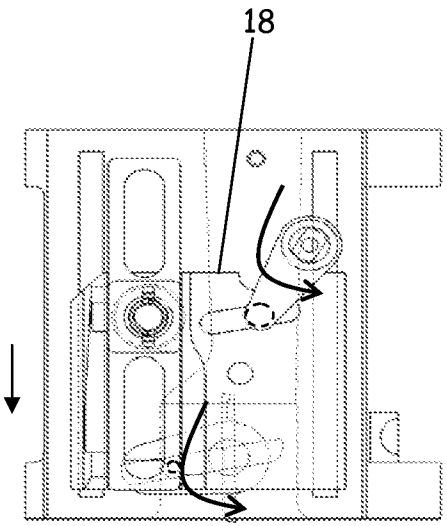
FIGS. 6A, 6B and 6C are views of the top of the carburettor of FIGS. 1 and 2 showing the positions of the various components at high load, medium load and when the engine is idling, respectively.
Figure 6B:
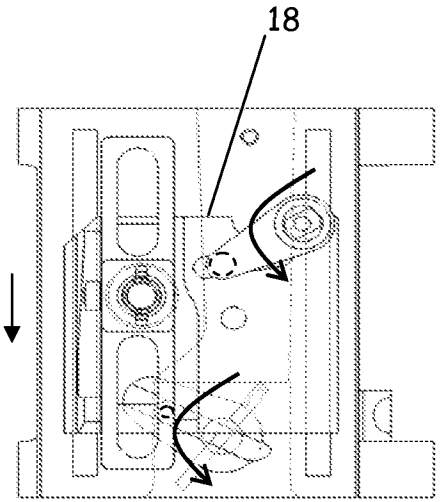
Figure 6A:
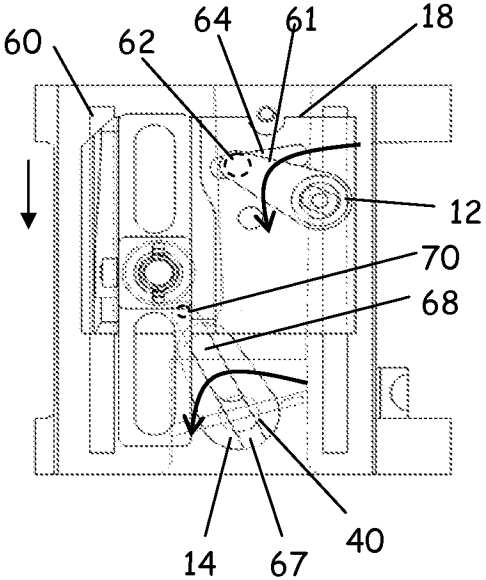
Figure 8:
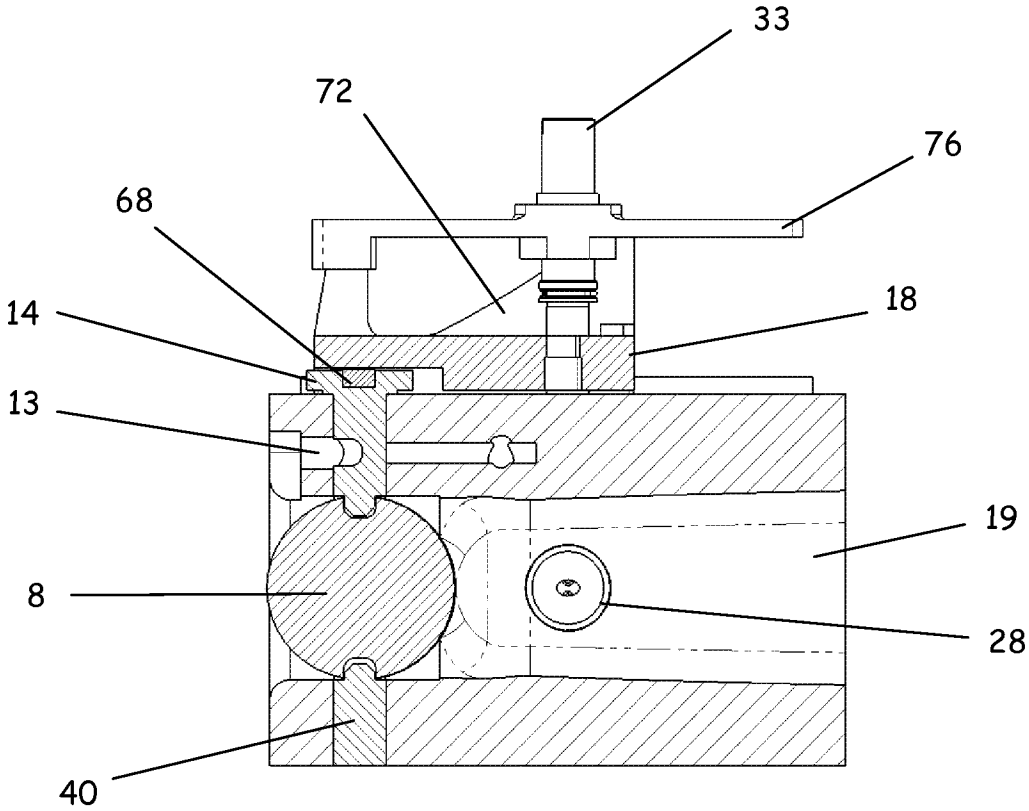
FIG. 8 is a vertical axial sectional view of the carburettor of FIGS. 1 and 2.

In use, the top of the carburettor is covered by a cover or lid (not shown) and springs (also not shown) are provided between the underside of the cover and the valve holder 76 to urge the latter downwardly such that the roller 78 is maintained in contact with the ramp 74. The input shaft 12 is connected to the engine speed control member, typically the speed governor of a stationary engine or the accelerator pedal of an automotive engine, such that movement of the speed control member will result in rotation of the shaft 12. When the engine is operating at idling speed, the position of the carriage 18 is as shown in FIGS. 2 and 6A. As will be seen, the roller 78 is in contact with the lowest portion of the ramp 74 and the valve member 33 is at its lowest position, as shown in FIGS. 4A and 7A, whereby the fuel metering valve is substantially closed and fuel metering is performed by the idling metering valve. In this condition, the throttle valve 8 is substantially closed. If the speed control member is now moved to an intermediate position, the input shaft 12 is rotated and this causes the carriage 18 to move along the slide rails 60. This in turn causes the throttle valve 8 to be rotated by the lost motion linkage 67, 68 to the intermediate position shown in FIG. 6B. The roller 78 moves to an intermediate position on the ramp 74 and the valve member 33 is moved up to an intermediate position, thereby permitting a larger amount of fuel to be admitted into the primary air passage of the carburettor. If the speed control member is now moved further to the full load/speed position, the input member 12 is rotated further and the carriage 18 is moved further to the position shown in FIGS. 1 and 6C. This movement is transmitted to the throttle valve 8, which is moved to the full open position, as also seen in FIG. 8. The roller 78 moves to the top of the ramp 74 which results in the valve member 35 being moved upwardly to its highest position, as seen in FIGS. 4B and 7C.

Figure 10:
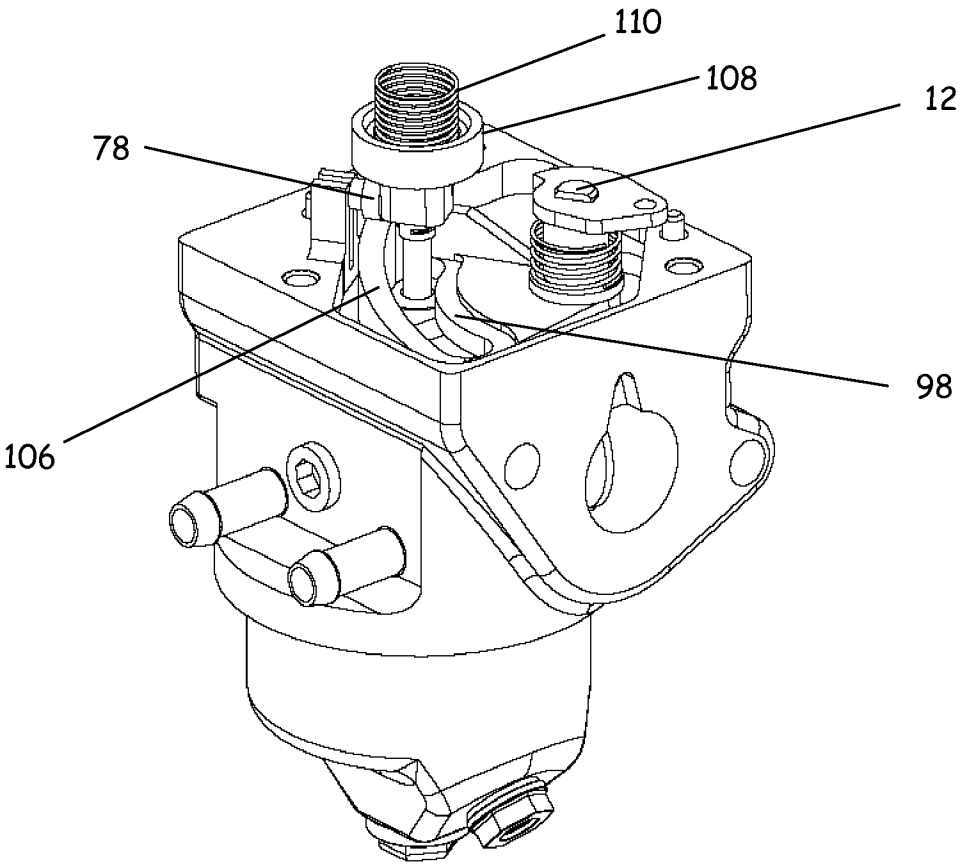
FIG. 10 is a perspective view of a further embodiment of carburettor in accordance with the invention with the upper cover removed.
Figure 11:
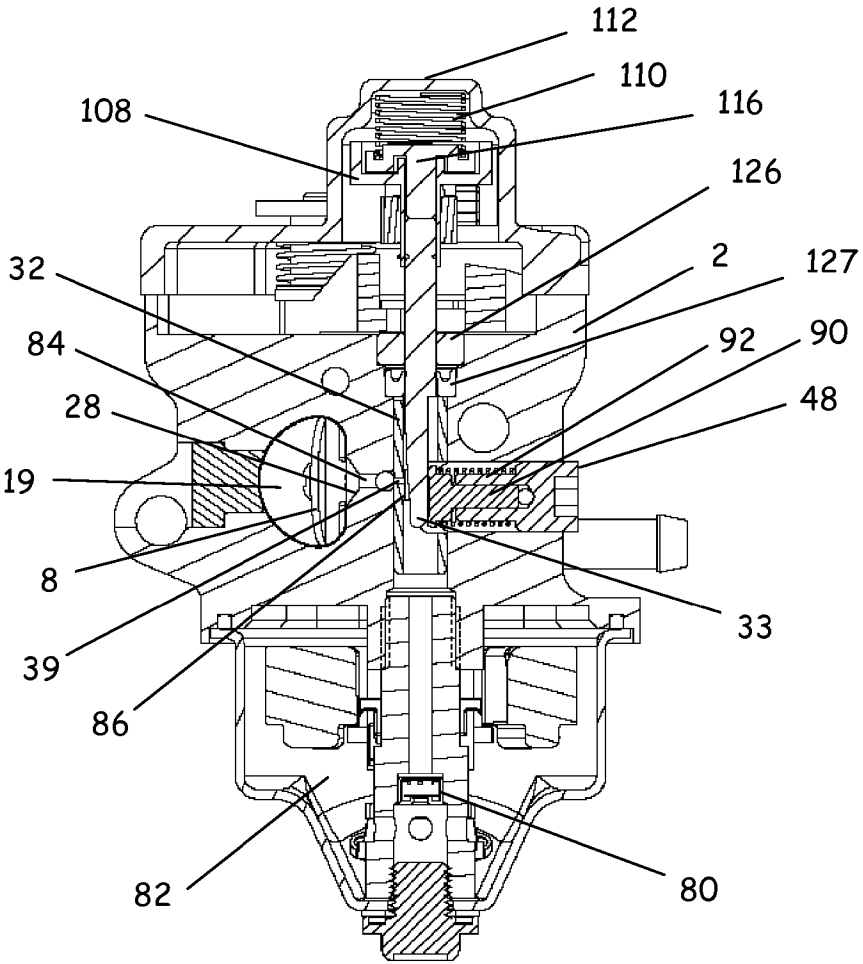
FIG. 11 is an axial sectional view of the carburettor of FIG. 10.
Figure 12:
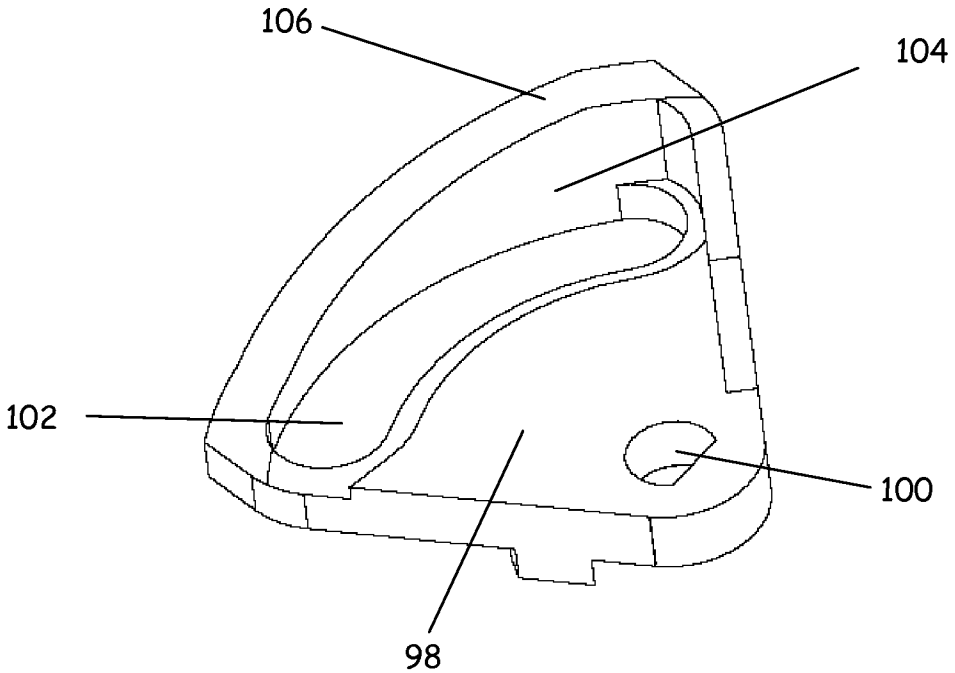
FIG. 12 is a perspective view of the rotary carriage seen in FIG. 10.

The modified embodiment of carburettor shown in FIGS. 10 to 12 is similar to the preceding embodiments but differs from it in a number of important respects.

In the preceding embodiments, the air fuel ratio at any particular position of the valve rod 33 is fixed by the manufacturer by precisely determining the profile of the valve rod. However, as a result of manufacturing tolerances and progressive wear of the carburettor and the associated engine it may be desirable for the carburettor to have an additional means of adjusting the air fuel ratio. This embodiment includes a composite control valve 80 situated between the carburettor float chamber 82 and the inlet to the fuel metering valve, which is both a non-return valve and an electrically operated flow control valve which, in use, is connected to a controller. This controller may be connected to a so-called λ sensor, which measures the oxygen concentration in the exhaust gases. The controller may be programmed to adjust the control valve 80 so that the oxygen concentration in the exhaust gases is zero, thereby indicating that the mixture is not too lean. The controller may also be responsive to signals indicative of the oil level in the engine sump, the engine temperature, the exhaust gas temperature and any other desired parameters. The control valve may be of any of a number of known types, e.g. with a valve member of oscillating, pulsating or rotary type. The control valve may also be used for the accurate control of the fuel flow when the engine is idling.

The valve sleeve 32 in this case is accommodated within a bore within the body 2. The outlet port 39 in the sleeve 32 communicates with a bore 84 in the body 2, which in turn communicates with the nozzle 28. In the embodiment of FIG. 3, for example, the nozzle 28 is made by drilling from the primary air passage 19 into the secondary air passage 25. This means that the area of communication between the two passages, i.e. the size of the nozzle aperture, is crucially dependent on the depth of the drilling and it is in practice very difficult to predetermine this size. This potential problem is overcome in this embodiment by using two drillings, the first of which is relatively small and of constant diameter, namely the bore 84 which communicates with the outlet port 39, and the second of which is relatively large and communicates with the primary air passage 19 and with the downstream end of the bore 84 and is of generally conical shape. This means that the minimum area of the communication between the primary and secondary passages is precisely predetermined and is equal to the area of the bore 84.

When the engine is idling, the throttle valve 8 is substantially closed. This means that a very low sub-atmospheric pressure prevails at the downstream end of the bore 84. The resulting large pressure differential tends to draw more fuel through the fuel metering valve than is required for idling operation. In the preceding embodiments, this is dealt with by very precisely machining the profile of the valve rod to en sure that the available flow area, when the engine is idling, permits precisely the required small volume of fuel to be drawn through the valve. However, this potential problem is mitigated in the present embodiment by dimensioning the secondary air passage such that its area is greater than the area of communication (bore 84) between the primary and secondary air passages. This results in the pressure in the secondary air passage not falling to a particularly low level, which means that the pressure drop between the fuel valve and the primary air passage occurs to a large extent between the primary and secondary air passage and not between the fuel valve and the secondary air passage. This enables the accuracy with which the profile of the valve member 33 must be machined to be relaxed somewhat. It will be appreciated that the increased area of the secondary air passage must be present over its entire length because if there were a constriction anywhere along its length, there would be a pressure drop at that point and this would increase the pressure differential between the fuel valve and the secondary air passage. This increased area of the secondary air passage may be provided by simply making the entire passage larger or by providing two or even more passages in parallel over at least a part of the length of the secondary air passage.

As may be seen in FIG. 11, the internal surface of the sleeve 32 is provided with a raised portion 86 which extends around the outlet port and projects beyond the surrounding portions of the internal surface by a small distance, which may be only 1mm or so. The valve member 33 is again provided with means which bias it towards the outlet port 39. In this case, the biasing means comprises a plug 48, which is received in a bore in the body 2 and defines a central bore 8 in which the stem of a generally mushroom-shaped biasing member is slidably received. Situated between the head of the biasing member and the plug 48 is a compression spring 92 which urges the head of the biasing against the valve member 33 and thus urges the valve member 33 against the raised portion 86. The valve member 33 is also slidably received in a bearing 126, below which is a seal 127. At other points along its length the valve member 33 is spaced from the internal surface of the sleeve 32. The combination of the raised portion 86 and the biasing device 48, 90, 92 means that the valve member 33 engages the internal surface of the sleeve 32 with an increased contact pressure and this improves the integrity of the seal around the outlet port 39.

In the preceding embodiment, the rotary throttle input connection is connected to a linearly slidable carriage via which the rotary input motion is converted into linear motion of the valve rod. However, in this embodiment, the rotary input shaft 12 is connected to a rotary carriage 98 which thus rotates with the shaft 12. As best seen in FIG. 12, the rotary carriage is of circular segmental shape with a non-circular hole 100 adjacent its apex by means of which it is rotationally keyed to the shaft 12. Adjacent its outer arcuate peripheral edge is an elongate arcuate opening 102, through which the valve member 33 extends. Extending adjacent to and outside the opening 102 is a part-circular wall 104 of progressively increasing height, the upper surface 106 of which constitutes an arcuate ramp surface. This ramp surface 106 is engaged by a roller 78, which is rotatably connected to move vertically with the valve member 33. The upper end of the valve member 33 is engaged by the stem of an inner mushroom-shaped engagement member 116, which is accommodated within an outer mushroom-shaped engagement member 108, which acts as a stop in the downward direction. The stem of the outer engagement member 108 is hollow and receives both the lower end of the inner engagement member 116 and the upper end of the valve member 33, which are in contact with one another. The external surface of the stem of the outer engagement member 108 is threaded and the thread is in engagement with a corresponding internal thread on the body 2. The datum position of the valve member 33 may thus be altered by rotating the engagement member 108 with respect to the body, thereby moving the inner engagement member 116 and thus also the valve member 33 axially. The upper surface of the inner engagement member 116 is engaged by one end of a compression spring 110, the other end of which is engaged by an outer cover 112. The two engagement members are therefore biased into engagement with one another, when the cover 112 is in position.

There are circumstances in which a carburettor can be required to supply metered amounts of one of two different fuels, such as gasoline and paraffin. This can readily be catered for by providing the valve member with a different profiled shape on two opposite sides, one of which is appropriate for one of the fuels and the other of which is appropriate for the other fuel. The carburettor can then readily be converted from being suitable for one fuel to being suitable for the other fuel by removing the valve member from a position in the sleeve in which one of the profiled shapes is opposed to the outlet and replacing it in a position in which the other is opposed to the outlet.

It may also be desirable for the carburettor to be able to supply precisely metered amounts of two different liquids simultaneously, e.g. gasoline and lubricating oil to a two-stroke engine. This may be readily achieved by providing the sleeve with two separate outlets, each of which cooperates with a respective profiled portion of the valve member and by dividing the fuel inlet space into two separate inlet spaces, each of which communicates with a respective inlet and with a respective profiled portion of the valve member.

The invention claimed is:

1. A carburettor further including a primary air passage, an adjustable throttle valve situated within the primary air passage, a fuel supply nozzle communicating with the primary air passage and connected to a valve member of a fuel metering valve for varying the amount of fuel discharged through the nozzle, and a rotary input shaft adapted to be connected to an engine speed control member and which is connected to the throttle valve to move the throttle valve between open and closed positions, the rotary input shaft being also connected to a carriage to move said carriage, the carriage carrying at least one inclined ramp surface means which extends in the direction of movement of the carriage and which is engaged by a follower connected to the valve member, wherein rotation of the input shaft results in movement of the throttle valve and in movement of the carriage and thus of the ramp surface means, so that the follower is movable transverse to the length of the ramp surface means and the valve member of the fuel metering valve is thus also moved.

2. A carburettor as claimed in claim 1 including at least one parallel track, the carriage being connected to a like number of support members which bear against respective tracks, wherein the carriage is guided to move linearly.

3. A carburettor as claimed in claim 2 in which the input shaft is connected to the carriage by a lost motion linkage.

4. A carburettor as claimed in claim 1 in which the throttle valve is connected to the carriage by a lost motion linkage.

5. A carburettor as claimed in claim 1 including at least one parallel ramp surface means and a valve carrier which is connected to the valve member and carries rollers which are supported on respective ramp surface means.

6. A carburettor as claimed in claim 1 in which the carriage is connected to the rotary input shaft to rotate with it and the ramp surface means is of particular shape.

* * * * *